US011519190B2

(12) United States Patent
Christine

(10) Patent No.: US 11,519,190 B2
(45) Date of Patent: Dec. 6, 2022

(54) WALL BRACE

(71) Applicant: Danny L Christine, Rittman, OH (US)

(72) Inventor: Danny L Christine, Rittman, OH (US)

( * ) Notice: Subject to any disclaimer, the term of this patent is extended or adjusted under 35 U.S.C. 154(b) by 0 days.

(21) Appl. No.: 17/580,101

(22) Filed: Jan. 20, 2022

(65) Prior Publication Data

US 2022/0235568 A1 Jul. 28, 2022

Related U.S. Application Data

(60) Provisional application No. 63/140,690, filed on Jan. 22, 2021.

(51) Int. Cl.
*E04G 23/02* (2006.01)

(52) U.S. Cl.
CPC ..... *E04G 23/0218* (2013.01)

(58) Field of Classification Search
CPC . E04G 23/0218; E04G 23/04; E04G 23/0229; E04G 23/0222; E02D 37/00; E02D 35/00; E04C 2003/026
See application file for complete search history.

(56) References Cited

U.S. PATENT DOCUMENTS 4,893,784 A * 1/1990 Abraham ..... E02D 37/00 254/100
5,459,967 A * 10/1995 Bodtker ..... E04H 5/10 52/127.2
5,845,450 A * 12/1998 Larsen ..... E02D 35/00 248/354.3
7,419,335 B1 * 9/2008 Cohen ..... E04G 23/0229 52/223.13
7,774,995 B1 * 8/2010 Zidar, Jr. ..... E04G 23/0218 52/715
8,136,317 B1 * 3/2012 McCown ..... E04G 23/0229 52/514
8,925,267 B1 * 1/2015 Kirby ..... E04G 23/0218 52/514
9,422,734 B1 * 8/2016 Heady ..... E04G 23/04
10,829,950 B1 * 11/2020 Fried ..... E04G 21/24
2005/0005561 A1 * 1/2005 Hanson ..... E04B 1/24 52/633
2006/0080926 A1 * 4/2006 Resch ..... E04G 23/0229 52/474
2007/0175174 A1 * 8/2007 Bruno ..... E04G 21/26 52/745.12
2012/0204512 A1 * 8/2012 Trinko ..... E04G 23/024 254/133 R (Continued)

*Primary Examiner* — Theodore V Adamos
(74) *Attorney, Agent, or Firm* — Black, McCuskey, Souers & Arbaugh LPA

(57) ABSTRACT

In an example embodiment, there is disclosed herein a wall brace comprising a floor mounting bracket, a lower main support that is coupled with the floor mounting bracket, an upper main support that slidingly engages the lower main support, an upper support bracket that is coupled with the upper main support, a wall support that is coupled with a wall support bracket that is coupled with the main support bracket. The upper main support and lower main support slide to adjust the length of the length of the wall brace. The wall support bracket can slide along the length of the lower main support to move the wall support to a desired height. A method of installing the bracket is also described.

10 Claims, 9 Drawing Sheets

(56) References Cited

U.S. PATENT DOCUMENTS

| | | | | |
|---|---|---|---|---|
| 2014/0360106 | A1* | 12/2014 | Sawyers | E04G 23/0229 52/127.2 |
| 2017/0167160 | A1* | 6/2017 | Beisser, III | E04H 17/266 |
| 2018/0245360 | A1* | 8/2018 | Woodford | E02D 35/00 |
| 2018/0245361 | A1* | 8/2018 | Waltz | E02D 17/08 |
| 2018/0283023 | A1* | 10/2018 | Heady | E02D 31/12 |

* cited by examiner

WALL BRACE

CROSS REFERENCE TO RELATED APPLICATIONS

This application claims the benefit under 35 U.S.C. § 119 of U.S. Provisional Application No. 63/140,690 filed Jan. 22, 2021, the contents of which are hereby incorporated by reference in their entirety.

TECHNICAL FIELD

The present disclosure relates generally to an apparatus and method for supporting a bowed or deflected wall.

BACKGROUND

Walls can bow or shift due to water intrusion, excess pressure from one side of the wall, or for many other reasons. It is important to repair the wall so that it can retain its integrity.

SUMMARY OF EXAMPLE EMBODIMENTS

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein an apparatus, referred to herein as a wall brace, comprising a floor mounting bracket, a lower main support that is coupled with the floor mounting bracket, an upper main support that slidingly engages the main support, an upper support bracket that is coupled with the upper main support, and a wall support coupled with a wall support bracket that is coupled with the lower main support. The upper main support and lower main support can slide to adjust the length of the length of the wall brace. The wall support bracket can slide along the length of the lower main support to move the wall support to a desired height.

In accordance with an example embodiment, there is disclosed herein a method of installing a wall brace.

BRIEF DESCRIPTION OF THE DRAWINGS

The accompanying drawings incorporated herein and forming a part of the specification illustrate the example embodiments.

DESCRIPTION OF EXAMPLE EMBODIMENTS

Figure 1:
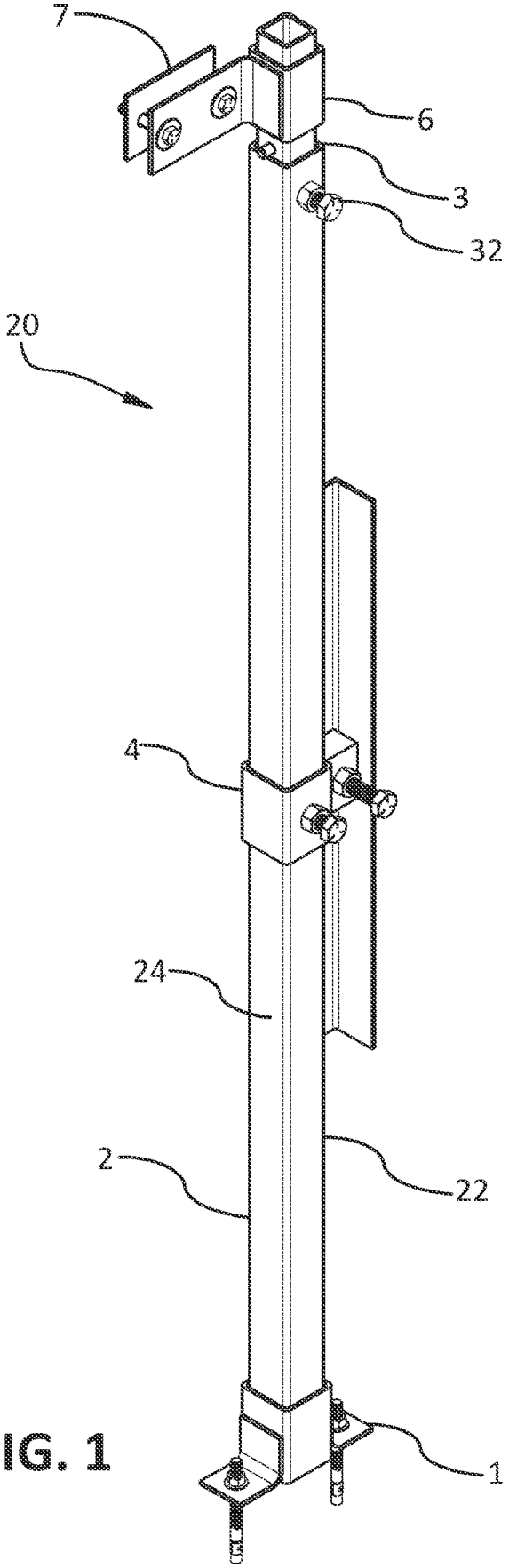
FIG. 1 is a perspective view of a wall brace, which can also be referred to as a wall anchor system.

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

Figure 2:
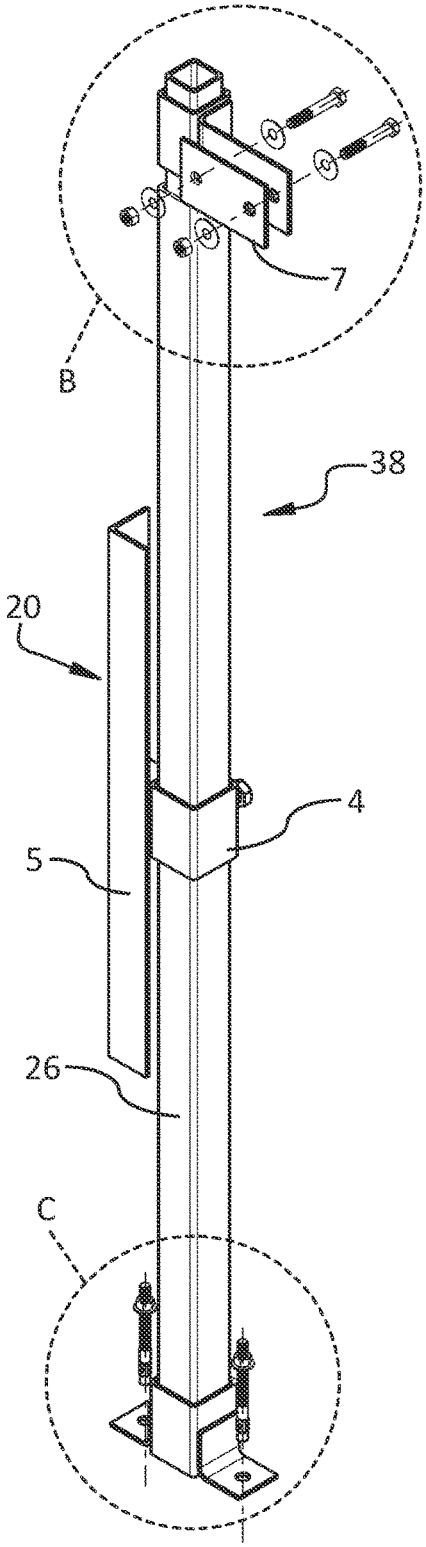
FIG. 2 is a second perspective view of the wall brace illustrated in FIG. 1.
Figure 3:
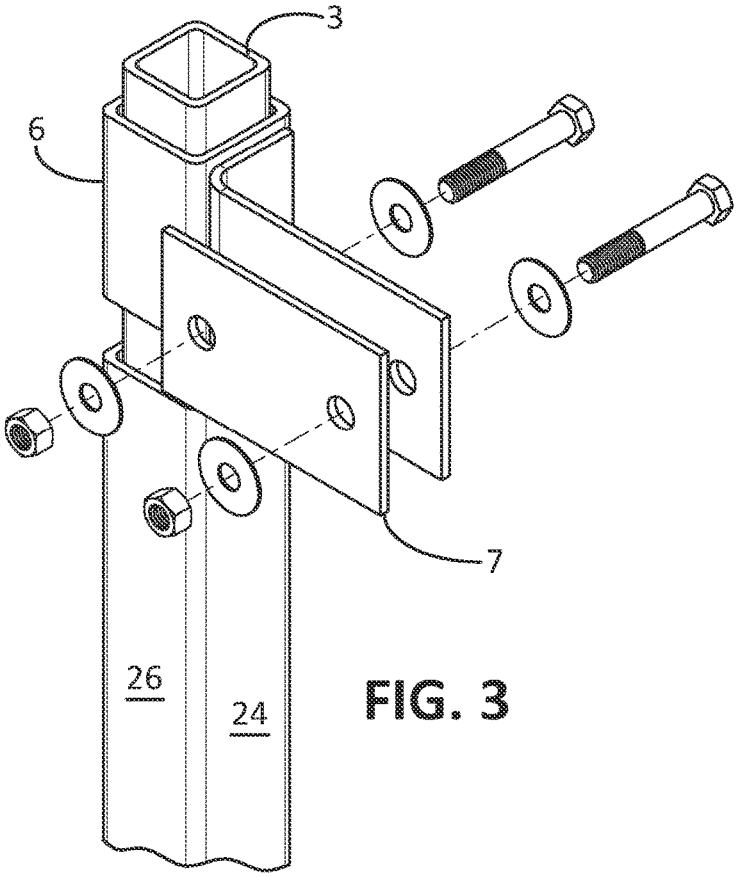
FIG. 3 is an exploded view of the area bounded by circle B in FIG. 2
Figure 4:
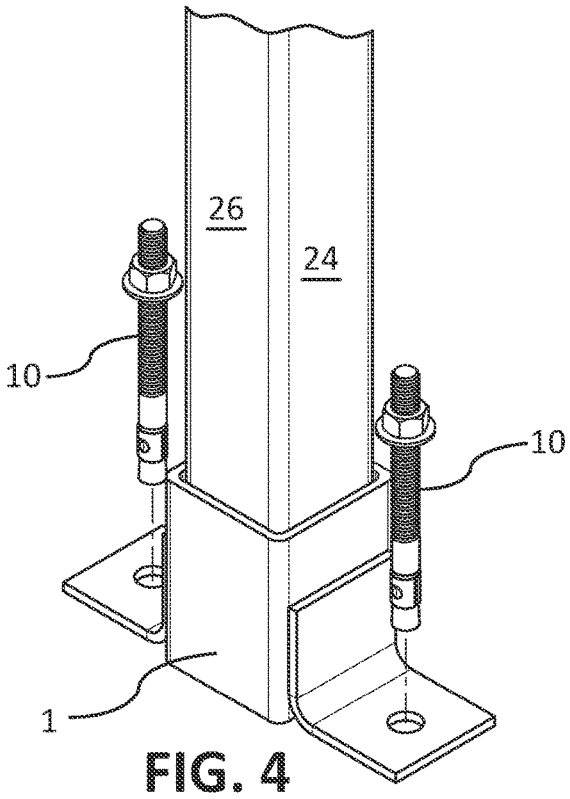
FIG. 4 is an exploded view of the area bounded by circle C in FIG. 2.
Figure 5:
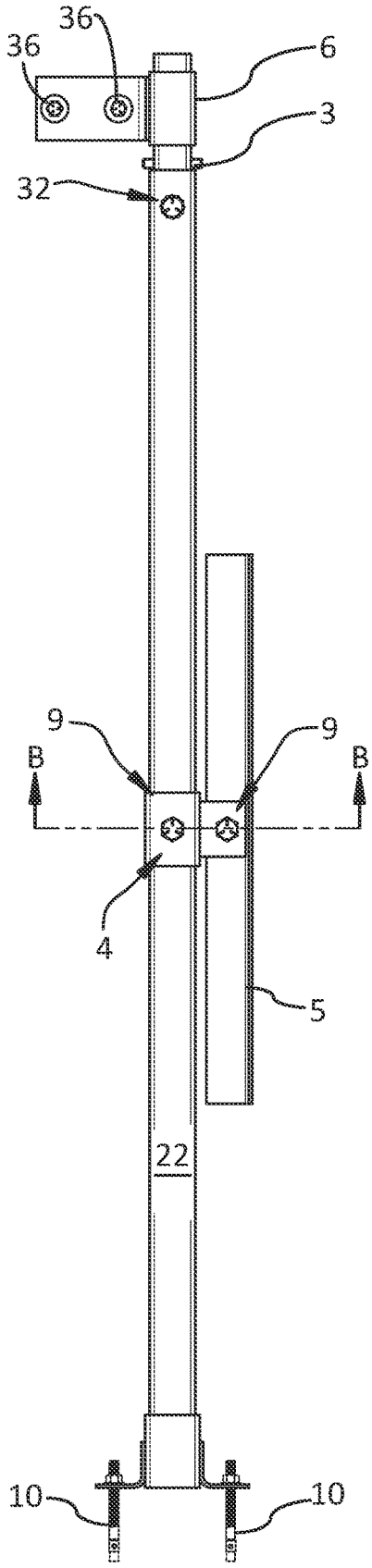
FIG. 5 is a side view of a first side of the wall brace.
Figure 6:
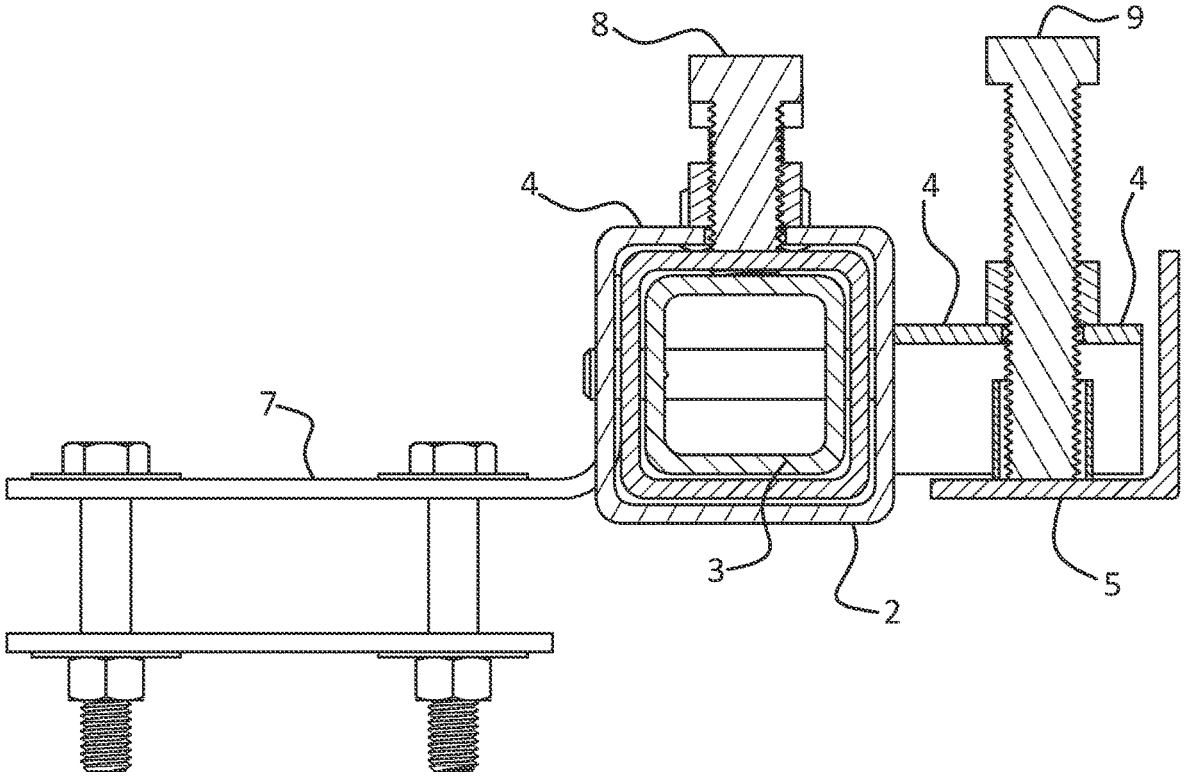
FIG. 6 is a cutaway view of the wall brace along line B-B in FIG. 5.
Figure 7:
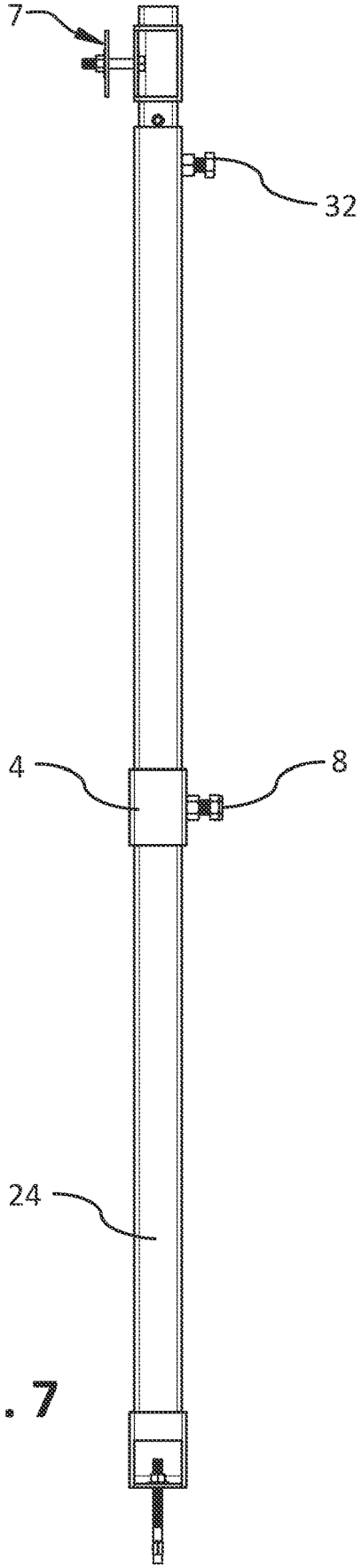
FIG. 7 is a side view of a second side of the wall brace.
Figure 8:
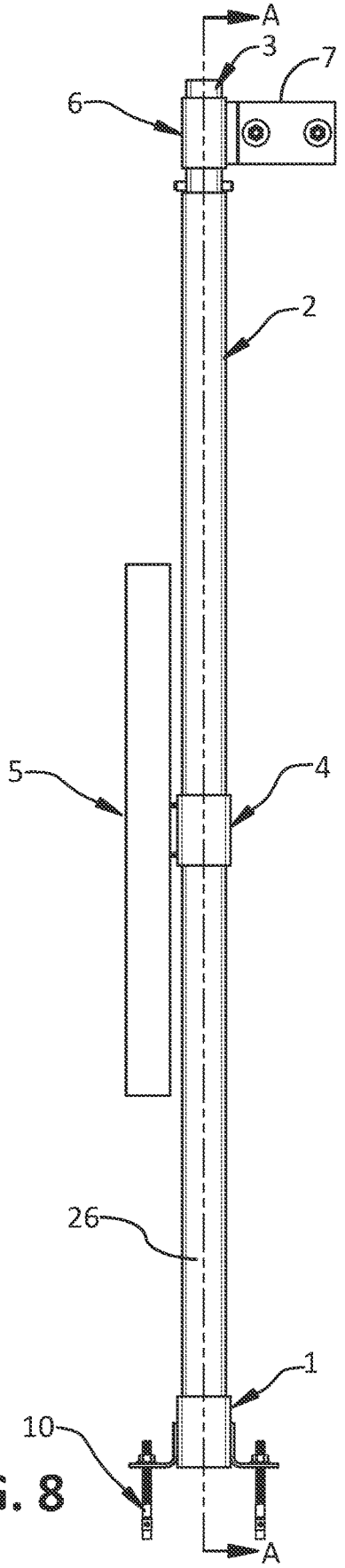
FIG. 8 is a side view of a third side of the wall brace.
Figure 9:
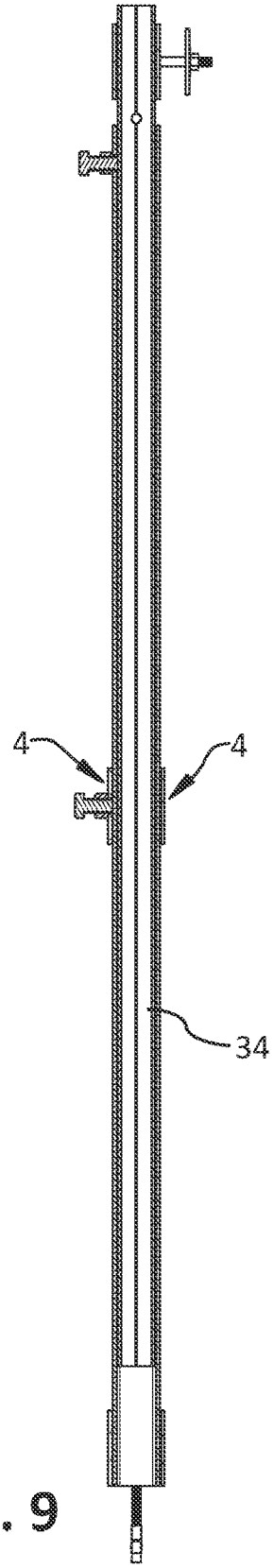
FIG. 9 is a cutaway view along line A-A in FIG. 8.
Figure 10:
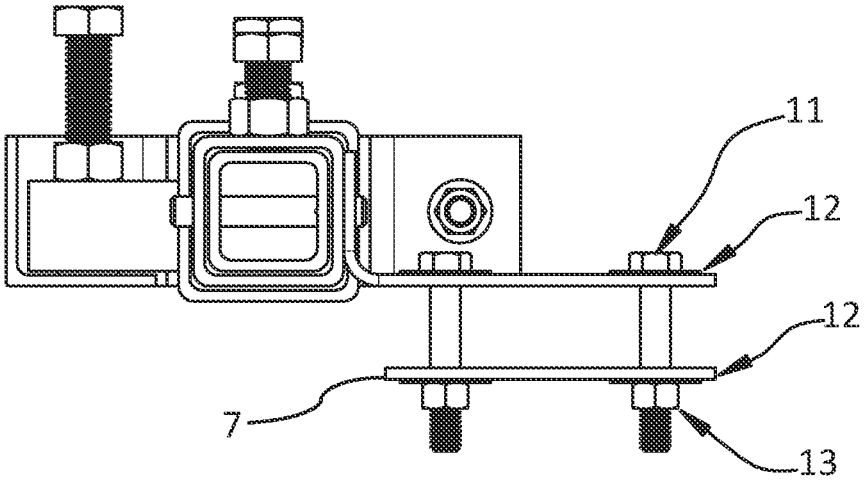
FIG. 10 is a top view of the wall brace as positioned in FIG. 8.
Figure 11:
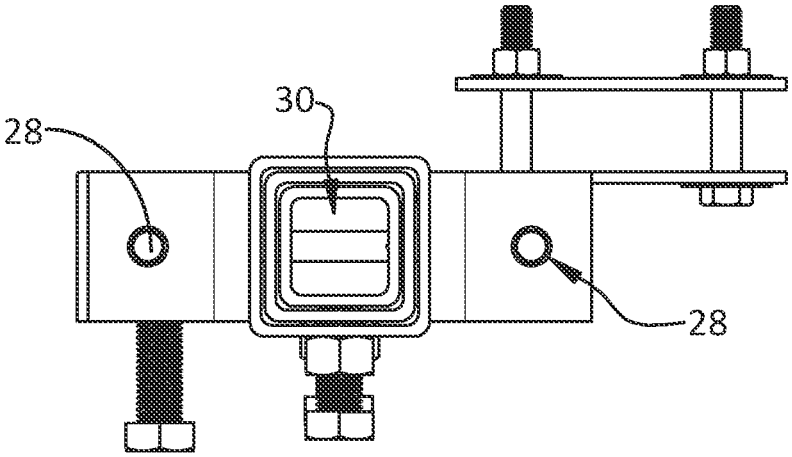
FIG. 11 is a bottom view of the wall brace as positioned in FIG. 8.

Referring to the drawings were FIGS. 1 and 2 are perspective views of a wall brace 20, in accordance with an example embodiment, FIG. 5 is a side view of a first side 22 of the wall brace 20, FIG. 7 is a side view of a second side 24 of the wall brace 20, and FIG. 8 is a side view of a third side 26 of the wall brace 20.

The wall brace 20 comprises a floor mounting bracket 1 that has mounting holes 28 for mounting the wall brace 20 onto a floor and an opening 30. Fasteners 10 couple the floor mounting bracket 1 to the bottom surface. In an example embodiment, the fasteners 10 are steel stud anchors for concrete which can be referred to as "Red Head" bolts. The opening 30 is configured to allow the lower main support 2 to be mounted therein. Although the shape of the lower main support 2 and upper main support 3 are illustrated as being square, those skilled in the art should readily appreciate that this is for ease of illustration and that any the lower main support 2 and upper main support 3 can be any suitable shape such as, for example, circular (tubular), triangular, or any other desired shape, such as a polygon. The opening 30 in the floor mounting bracket 1 can be configured accordingly.

The upper main support 3 is shaped to slidingly engage the lower main support 2. In an example embodiment, the lower main support 2 is hollow and the upper main support 3 fits inside the lower main support 2, however, in other embodiments, the upper main support 3 is hollow and the lower main support fits 2 inside the upper main support 3. In an example embodiment, a threaded fastener 32, such as for example a hexagonal head cap screw, is employed to hold the upper main support 3 in place. The upper support bracket 6 is mounted onto the upper main support 3. The joist support plate 7 has mounting holes 36 for receiving fasteners for to couple the joist support plate 7 of the wall brace 20 onto a joist. In the illustrated example, the fastener comprises a hexagonal cap screw 11, flat washers 12, and hexagonal nuts 13, although those skilled in the art can readily appreciate any suitable fastener can be employed.

In an example embodiment, a wall support bracket 4 which is coupled with the wall support plate 5 slides on the outer surface 38 of the lower main support 2. The wall support bracket 4 slides along the outer surface 38 of the lower main support 2 and is held in place by tightening fastener 8. In an example embodiment, the fastener 8 is a hexagonal head cap screw, although any suitable type of threaded fastener may be employed to hold the wall support bracket 4 at a desired position on the lower main support 2. Wall support plate fastener 9 is employed to move the wall support plate 5 against the wall being supported. In an example embodiment, the wall support plate fastener 9 is a hexagonal head cap screw. Tightening the wall support plate fastener 9 pushes the wall support plate 5 against the wall being supported, and in an example embodiment causes the wall support plate to apply a force to the wall being supported. In another example embodiment, for example where the upper main support is hollow and the lower main support 2 slides inside of the upper main support 3, the wall support bracket 4 slides on the outside of the upper main support 3.

Figure 12:
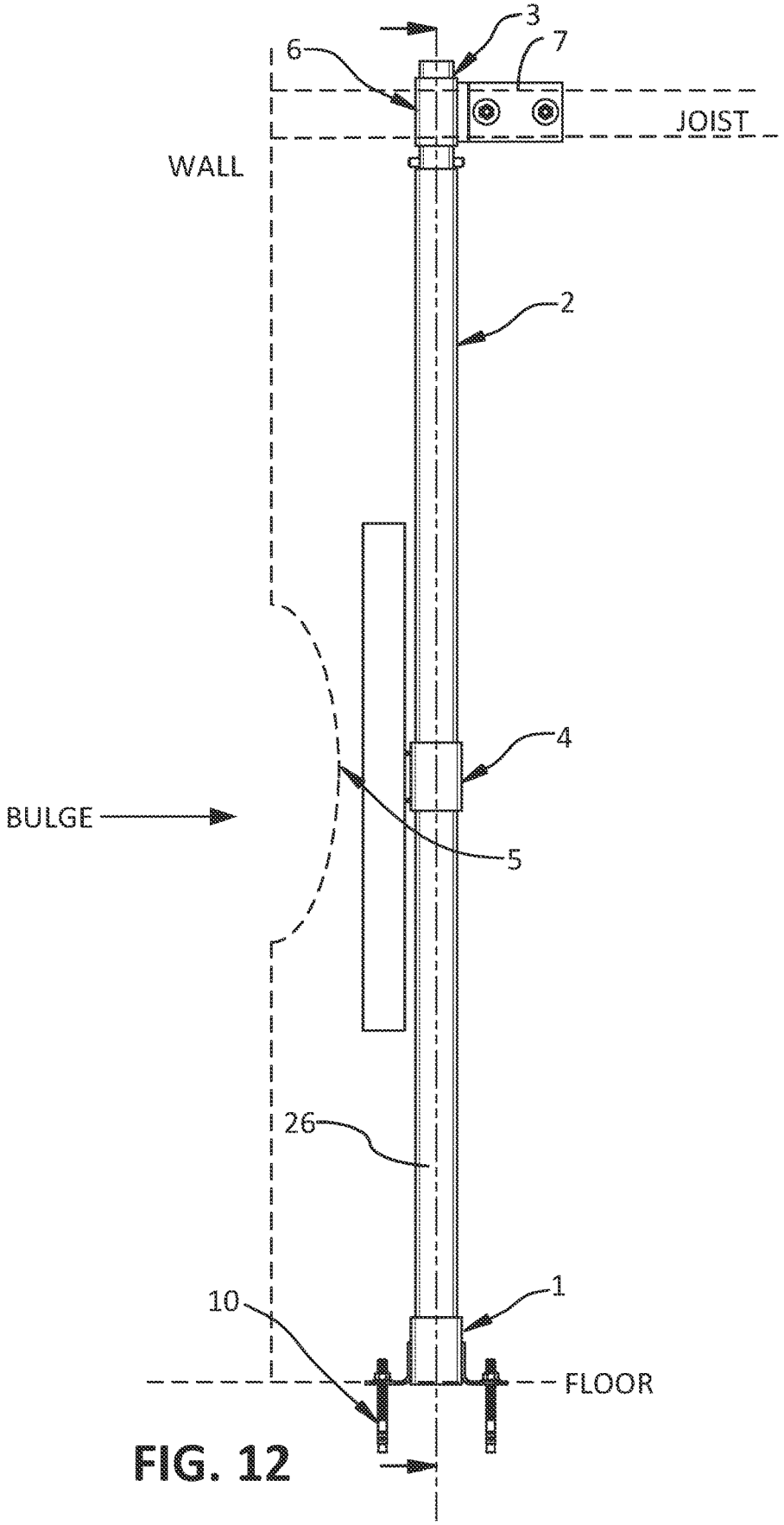
FIG. 12 illustrates an example of the wall bracket support a wall.

FIG. 12 illustrates an example of the wall bracket support a wall. Note that some of the features in FIG. 12 may be slightly exaggerated for ease of illustration. The wall brace 20 is placed adjacent to the bulge (BULGE) in the wall (WALL). The floor mounting bracket 1 is mounted onto the floor (FLOOR) and held in place by fasteners 10. The upper main support 3, which is coupled with the upper support bracket 6, is adjusted so that the joist support plate 7 is aligned with the joist (JOIST) at the top of the wall. Fastener 32 is tightened to hold the upper support bracket 6 in place. The wall support bracket 4 is moved along the lower main support 2 to position the wall support plate 5 against the bulge in the wall. Fastener 8 is tightened to hold the wall support bracket 4 in place. Wall support plate fastener 9 is tightened to press the wall support against the bulge and repair the wall.

Figure 13:
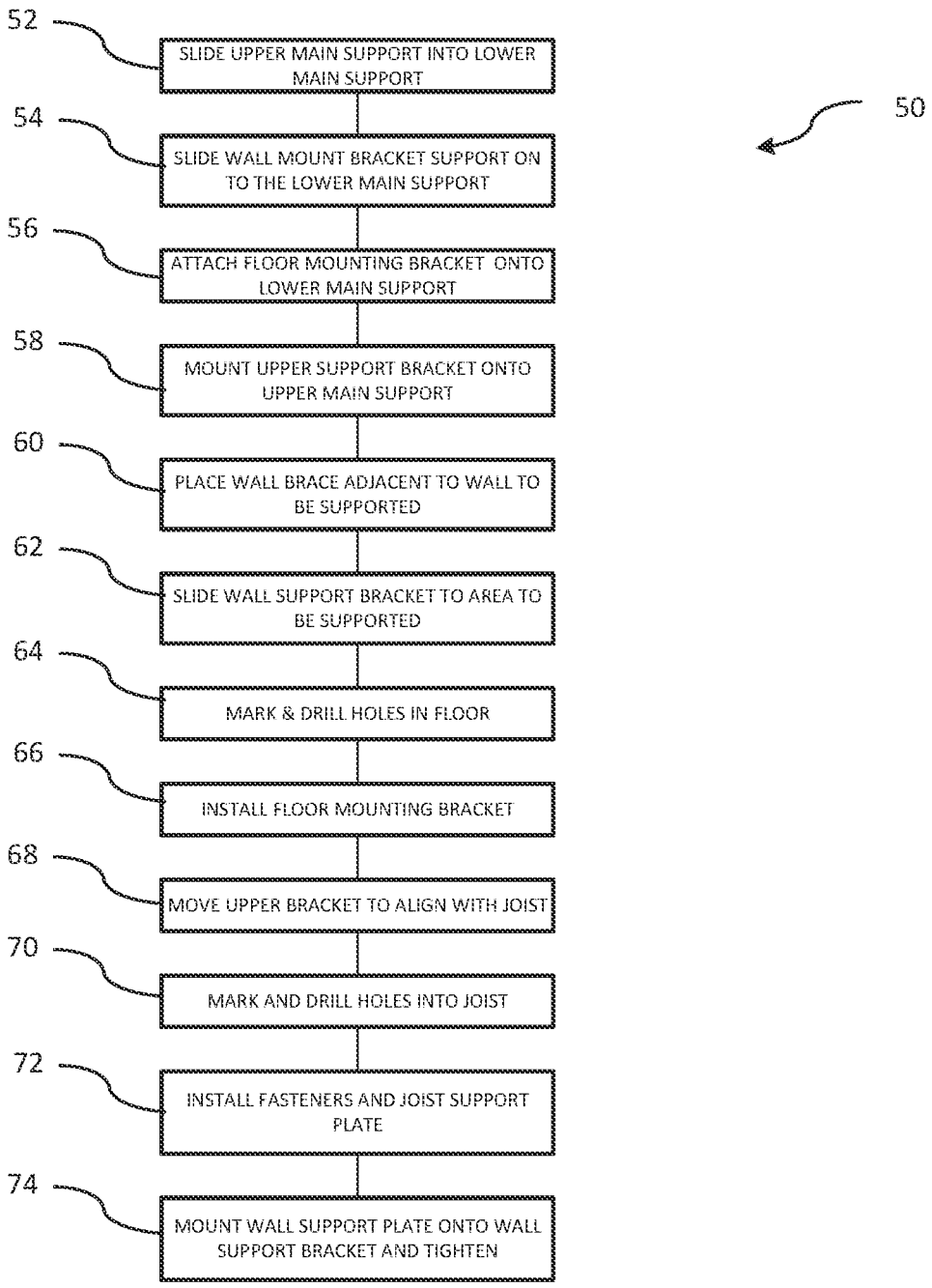
FIG. 13 illustrates an example of how to install the wall bracket to repair a wall.

In view of the foregoing structural and functional features described above, a methodology 50 in accordance with an example embodiment will be better appreciated with reference to FIG. 13. While, for purposes of simplicity of explanation, the methodology 50 of FIG. 13 is shown and described as executing serially, it is to be understood and appreciated that the example embodiment is not limited by the illustrated order, as some aspects could occur in different orders and/or concurrently with other aspects from that shown and described herein. Moreover, not all illustrated features may be required to implement the methodology 50 in accordance with an example embodiment.

Described above are example embodiments. It is, of course, not possible to describe every conceivable combination of components or methodologies for purposes of describing the example embodiments, but one of ordinary skill in the art will recognize that many further combinations and permutations of the example embodiments are possible. Accordingly, it is intended to embrace all such alterations, modifications and variations that fall within the spirit and scope of any claims filed in applications claiming priority hereto interpreted in accordance with the breadth to which they are fairly, legally and equitably entitled.

At 52 the upper main support slides into the lower main support. For example, in FIGS. 1-11, the upper main support 3 slides into the lower main support 2. However, as those skilled in the art can readily appreciate, in another embodiment, the lower main support can slide into the upper main support. This allows for adjustment of the length of the wall brace.

At 54, the wall support bracket slides onto the lower main support. For example, in FIGS. 1-11, the wall support bracket 4 is slid onto the lower main support 2. Optionally, fastener 8 may be tightened to prevent the wall support bracket 4 from sliding. In another example embodiment, the wall support bracket is slid onto the upper main support.

At 56, the floor mounting bracket is attached to the lower main support. For example, in FIGS. 1-11, the lower main support 2 is inserted into the opening 30 of the floor mounting bracket 1.

At 58, the upper support bracket is mount onto the upper main support. For example, in FIGS. 1-11, the upper support bracket 6 is mounted onto upper main support 3 at the end opposite where the floor mounting bracket 1 is attached.

At 60, the wall brace is placed adjacent to the wall being supported or repaired. For example, wall brace 20 as positioned as illustrated in FIG. 12.

At 62, the wall support bracket is moved to the area on the wall that is being supported or repaired. This can be an area where a bulge in the wall protrudes the most. FIG. 12 illustrates an example of the wall support bracket 4 being moved adjacent to the bulge in the wall. Fastener 8 may be loosened to move the wall support bracket 4 to the desired location and fastener 8 can be tightened sufficiently to prevent the wall support bracket 4 from moving once in position.

At 64, the position of the holes for the floor mounting bracket are marked and holes are drilled into the floor. For example, in FIGS. 1-11, the location of holes 28 of the floor mounting bracket 1 are marked on the floor and the appropriate holes are drilled into the floor for receiving fasteners 10.

At 66, the floor mounts are installed. For example, in FIGS. 1-11, the fasteners 10 are installed. For concrete floors, fasteners 10 can be concrete anchors such as, for example, steel stud anchors.

At 68, the upper support bracket is moved to align with the joist. FIG. 12 illustrates an example of the upper support bracket 6 aligned with the joist. Optionally, fastener 32 can be tightened to prevent movement of the upper support bracket 6.

At 70, the location of the holes to be drilled into the joists that align with the joist support plate are marked and drilled.

At 72, the fasteners and joist support plate are installed. For example, in FIGS. 1-11 a hexagonal head cap screw and flat washer are installed on the side adjacent to the wall support bracket and the joist support plate 7, is mounted onto the head cap screw and held in place by a flat washer and nut. However, those skilled in the art can appreciate that in another embodiment, the bolt can be inserted into the joist support plate and then inserted into the holes drilled into the joists.

At 74, the wall support plate is mounted onto the wall support brace support. For example, in FIGS. 1-11, the wall support plate 5 is mounted onto wall support bracket 4 and wall support plate fastener 9 is tightened to press the wall support plate 5 against the bulge (see, e.g., FIG. 12). After installation, the wall support plate fastener 9 may be tightened as the ground outside the wall freezes and thaws.

The invention claimed is:

1. An apparatus, comprising:

a floor mounting bracket;

a lower main support coupled with the floor mounting bracket;

an upper main support that slidingly engages the lower main support;

an upper support bracket coupled with the upper main support;

a joist support plate coupled with the upper support bracket;

a wall support bracket having a surface with a threaded opening configured to slidingly engage one of a group consisting of the lower main support and the upper main support;

a wall support plate coupled via a wall support fastener passing through the threaded opening of the surface with the wall support bracket;

a tightening fastener coupled with the wall support bracket and configured to engage the one of the group consisting of the lower main support and the upper main support to hold the wall support bracket in position; and the wall support fastener that is coupled with the wall support plate and the wall support bracket is configured where tightening the wall support fastener moves the wall support plate against a surface to be supported.

2. The apparatus set forth in claim 1, wherein the lower main support is hollow and the upper main support slides inside of the lower main support.

3. The apparatus set forth in claim 2, wherein the wall support bracket slidingly engages the lower main support.

4. The apparatus set forth in claim 1, wherein the upper main support is hollow and the lower main support slides inside of the upper main support.

5. The apparatus set forth in claim 4, wherein the wall support bracket slidingly engages the upper main support.

6. The apparatus set forth in claim 1, wherein the upper support bracket slidingly engages the upper main support.

7. The apparatus set forth in claim 6, wherein the joist support plate has a plurality of mounting holes.

8. The apparatus set forth in claim 1, wherein the floor mounting bracket has a plurality of mounting holes.

9. A method, comprising:

attaching a floor mounting bracket of a wall brace onto a lower main support of the wall brace;

placing the wall brace adjacent to a wall to be supported;

sliding a wall support bracket along the lower main support adjacent to an area of the wall to be supported;

installing the floor mounting bracket onto a floor;

aligning joist support plates coupled with an upper bracket of the wall brace with a joist;

attaching the joist support plates to the joist;

holding the wall support bracket to the lower main support at a desired position with a tightening fastener that engages the lower main support;

mounting a wall support plate onto a wall support plate fastener passing through a threaded opening located on a surface of the wall support bracket that is extending away from the wall brace; and tightening the wall support plate fastener to move the wall support plate against the area of the wall to be supported.

10. The method of claim 9, wherein aligning the joist support plates further comprises sliding the upper bracket to align the joist support plates with the joist.

* * * * *